US009702578B2

(12) United States Patent
Yonezawa et al.

(10) Patent No.: US 9,702,578 B2
(45) Date of Patent: Jul. 11, 2017

(54) AIR CONDITIONING CONTROL SYSTEM FOR CONTROLLING OUTSIDE AIR CONTROL AND RETURN AIR CONTROL OF AIR CONDITIONING SYSTEM

(75) Inventors: Kenzo Yonezawa, Tama (JP); Yasuo Takagi, Chigasaki (JP); Nobutaka Nishimura, Koganei (JP); Yuuichi Hanada, Shiraoka-machi (JP); Naoki Makino, Tokyo (JP); Hideki Oono, Koganei (JP); Akihiro Fujii, Tokorzawa (JP); Susumu Sugawara, Tachikawa (JP); Tomonori Maegawa, Tokyo (JP); Hiroshi Morimoto, Chiba (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 1410 days.

(21) Appl. No.: 12/499,540

(22) Filed: Jul. 8, 2009

(65) Prior Publication Data

US 2010/0006662 A1 Jan. 14, 2010

(30) Foreign Application Priority Data

Jul. 11, 2008 (JP) ..... P2008-181253

(51) Int. Cl.
*F25D 17/04* (2006.01)
*F24F 3/14* (2006.01)
(Continued)

(52) U.S. Cl.
CPC ..... *F24F 11/0009* (2013.01); *F24F 5/0096* (2013.01); *F24F 11/0008* (2013.01);
(Continued)

(58) Field of Classification Search
CPC ..... F24F 3/14; F24F 5/0096; F24F 11/0009; F24F 11/0008; F24F 11/0015;
(Continued)

(56) References Cited

U.S. PATENT DOCUMENTS 3,979,922 A * 9/1976 Shavit ..... 62/97
4,044,947 A * 8/1977 Spethmann ..... 236/13
(Continued)

FOREIGN PATENT DOCUMENTS

CN 2332947 Y 8/1999
DE 694 17 411 T2 8/1999
(Continued)

OTHER PUBLICATIONS

Notification of Second Office Action issued by the State Intellectual Property Office of the People's Republic of China, for Chinese Patent Application No. 200910140061.7, and English-language translation thereof.
(Continued)

*Primary Examiner* — Marc Norman
*Assistant Examiner* — Daniel C Comings
(74) *Attorney, Agent, or Firm* — Finnegan, Henderson, Farabow, Garrett & Dunner LLP

(57) ABSTRACT

An air conditioning control system allows a supply air switching controller to alternately switch outside air control and return air control at a preset switching interval. The supply air switching controller is connected to an air conditioner placed to correspond to each room inside as an air conditioning control subject. The outside air control takes outside air into a temperature/humidity adjustment coil of the air conditioner by opening a first damper provided in the air conditioner in order to adjust an intake volume of the outside air into the air conditioner and by closing a second damper provided in the air conditioner in order to adjust an intake volume of return air from the room inside. The return air control takes the return air from the room inside into the temperature/humidity adjustment coil of the air conditioner by closing the first damper and opening the second damper.

10 Claims, 3 Drawing Sheets

(51) Int. Cl.

| | |
|---|---|
| ***F24F 11/00*** | (2006.01) |
| ***G05D 22/02*** | (2006.01) |
| ***F23N 5/20*** | (2006.01) |
| ***G05D 23/00*** | (2006.01) |
| ***F24F 7/00*** | (2006.01) |
| ***F24F 5/00*** | (2006.01) |

(52) U.S. Cl.
CPC ..... *F24F 11/0012* (2013.01); *F24F 11/0015* (2013.01); *F24F 11/0034* (2013.01); *F24F 2011/0013* (2013.01); *F24F 2011/0016* (2013.01); *F24F 2011/0073* (2013.01)

(58) Field of Classification Search
CPC ..... F24F 11/0012; F24F 2011/0013; F24F 2011/0016; F24F 11/0034; F24F 2011/0073
USPC ..... 62/93, 157, 158, 176.4, 176.6, 177–180, 62/186, 404, 133, 230, 239, 244, 408, 62/410; 236/44 C, 46 R, 49.3
See application file for complete search history.

(56) References Cited

U.S. PATENT DOCUMENTS

| | | | | |
|---|---|---|---|---|
| 4,186,564 | A * | 2/1980 | Myers | 62/180 |
| 4,347,712 | A * | 9/1982 | Benton et al. | 62/175 |
| 4,485,632 | A * | 12/1984 | Gallagher | 62/179 |
| 4,506,514 | A * | 3/1985 | Lamar et al. | 62/91 |
| 4,517,810 | A * | 5/1985 | Foley et al. | 62/186 |
| 5,170,935 | A * | 12/1992 | Federspiel et al. | 236/44 C |
| 5,590,830 | A | 1/1997 | Kettler et al. | |
| 5,791,408 | A * | 8/1998 | Seem | 165/250 |
| 6,006,142 | A * | 12/1999 | Seem et al. | 700/276 |
| 6,415,617 | B1 * | 7/2002 | Seem | 62/186 |
| 6,470,697 | B2 * | 10/2002 | Nakamura | B60H 1/3207 62/157 |
| 6,826,920 | B2 * | 12/2004 | Wacker | 62/176.6 |
| 6,916,239 | B2 * | 7/2005 | Siddaramanna et al. | 454/256 |
| 7,757,504 | B2 * | 7/2010 | Yonezawa et al. | 62/176.6 |
| 7,827,812 | B2 * | 11/2010 | Yabu et al. | 62/186 |
| 2003/0155429 | A1 | 8/2003 | Sparling et al. | |
| 2005/0028970 | A1 | 2/2005 | Sekhar et al. | |
| 2005/0156052 | A1 * | 7/2005 | Bartlett | F24F 11/0001 236/49.3 |
| 2006/0130502 | A1 * | 6/2006 | Wruck et al. | 62/186 |
| 2006/0183419 | A1 | 8/2006 | Kettler | |
| 2007/0240437 | A1 * | 10/2007 | Yonezawa et al. | 62/176.1 |
| 2008/0092565 | A1 * | 4/2008 | Yabu et al. | 62/94 |
| 2008/0179409 | A1 * | 7/2008 | Seem | 236/49.3 |

FOREIGN PATENT DOCUMENTS

| | | |
|---|---|---|
| EP | 0 892 330 B1 | 10/2002 |
| JP | 64-38546 | 2/1989 |
| JP | 2540875 | 7/1996 |
| JP | 2006-132851 | 5/2006 |
| JP | 2006-292300 | 10/2006 |
| JP | 2007-132537 | 5/2007 |
| JP | 2008-232507 | 10/2008 |
| JP | 2008-256258 | 10/2008 |

OTHER PUBLICATIONS

Notification of Reasons for Rejection issued by the Japanese Patent Office on Aug. 3, 2010, for Japanese Patent Application No. 2008-181253, and English-language abstract thereof.
Notification of Reasons for Rejection issued by the Korean Patent Office on Feb. 21, 2011, for Korean Patent Application No. 10-2009-0061997, and English-language translation thereof.
Official Action issued by the German Patent and Trade Mark Office on Jul. 13, 2015, for German Patent Application No. 10 2009 032 636.7, and English-language translation thereof.

* cited by examiner

AIR CONDITIONING CONTROL SYSTEM FOR CONTROLLING OUTSIDE AIR CONTROL AND RETURN AIR CONTROL OF AIR CONDITIONING SYSTEM

BACKGROUND OF THE INVENTION

1. Field of the Invention

The present invention relates to an air conditioning control system that controls air conditions in an office, a hospital and the like, to a supply air switching controller for use in the air conditioning control system, and to an air conditioning control method.

2. Description of the Related Art

A heat sensation of a human body is affected by a plurality of factors such as a room temperature, an indoor humidity, a mean radiant temperature, an action quantity, a clothing quantity and an air velocity.

However, in usual, in a place in an office building, where persons are present, an air velocity is 0.1 m/s or less, and accordingly, the heat sensation is hardly affected thereby. Moreover, the clothing quantity is fixed by a season such as summer and winter, and the action quantity is determined to some extent by a type of a building in terms of use, such as the office building and a department store. Furthermore, the mean radiant temperature substantially follows the room temperature except on a window side.

Hence, when the above-described respective factors are examined, the humidity is the second factor that largely affects amenity of the persons after the room temperature.

FIG. 1 shows, as a range A, a combination of the room temperature and the humidity, which is defined so that an amenity index (predicted mean vote: PMV) in which the amenity of the persons is represented by a numerical value can stay within a comfortable range of 0.3 to 0.5 (in the case of considering to save energy at the time of cooling in summer).

As shown by this range A, the humidity is lowered to some extent, whereby the amenity can be obtained without lowering the room temperature more than necessary.

However, in actual, air conditioning control in many office buildings mostly performs only room temperature control, and the humidity is not taken into consideration at all.

A reason for the above is as follows. In the case of also attempting to control the humidity at such a cooling time, when air to be controlled is dehumidified, the air is cooled excessively by a cold water coil. Therefore, in order to adjust a supply air temperature, a process of a reheating cycle of the air in a heating coil becomes necessary. As a result, when the humidity is also attempted to be controlled at the cooling time, extremely large energy is consumed in comparison with the case of only the temperature control.

Accordingly, in order to solve such a problem as described above, an air conditioning control apparatus in which a direct expansion coil that dehumidifies outside air is added to an air conditioner has been proposed in Patent Publication 1 (Japanese Patent Laid-Open Publication No. 2006-292300).

As shown in FIG. 2, the air conditioner using a technology of Patent Publication 1 includes: a direct expansion coil 41 that introduces and dehumidifies the outside air; a cold/hot water coil 42 that cools return air from a room inside subjected to the air conditioning control and adjusts a temperature of supply air to the room inside; and a supply air fan 43 that supplies mixed air of the outside air dehumidified by the direct expansion coil 41 and the return air cooled by the cold/hot water coil 42 into the room inside subjected to the air conditioning control. As described above, in the air conditioner using the technology of Patent Publication 1, the dehumidification of the outside air and the cooling of the return air are performed independently of each other, whereby it becomes possible to perform air conditioning control, in which the amenity is maintained, while achieving energy saving.

SUMMARY OF THE INVENTION

However, in the air conditioner using the technology of Patent Publication 1 described above, it is necessary to add the direct expansion coil, and following this, to change/add an air duct, a water pipe and the like. Accordingly, there has been a problem that the conventional air conditioner cannot be used as it is, resulting in a cost increase.

The present invention has been created in consideration for the above-described circumstances. It is an object of the present invention to provide an air conditioning control system, a supply air switching controller for use in the air conditioning control system, and an air conditioning control method, which are capable of performing air conditioning control in which maintenance of the amenity and enhancement of an effect of saving the energy are compatible with each other without requiring addition of new instruments of the air conditioner, such as the direct expansion coil.

In order to achieve the above-described object, an air conditioning control system according to a first aspect of the present invention includes:

a temperature/humidity adjustment coil that performs adjustment processing for a temperature and humidity of air as a control subject;

a first damper that is placed in an air pipe coupling a space of a room outside and the temperature/humidity adjustment coil to each other, and adjusts an intake volume of outside air;

a second damper that is placed in an air pipe coupling a space of a room inside as an air conditioning control subject and the temperature/humidity adjustment coil to each other, and adjusts an intake volume of return air from the room inside; and a damper control unit that alternately switches outside air control and return air control at a preset switching interval, in which the outside air control is to take the outside air into the temperature/humidity adjustment coil by opening the first damper and closing the second damper, and the return air control is to take the return air from the room inside into the temperature/humidity adjustment coil by closing the first damper and opening the second damper.

Moreover, a supply air switching controller according to a second aspect of the present invention includes: a damper control unit connected to an air conditioner placed to correspond to each room inside or each control zone of the room inside, the room inside or the control zone being as an air conditioning control subject, wherein the damper control unit alternately switches outside air control and return air control at a preset switching interval, in which the outside air control is to take outside air into a temperature/humidity adjustment coil of the air conditioner by opening a first damper that is provided in the air conditioner and adjusts an intake volume of the outside air into the air conditioner and by closing a second damper that is provided in the air conditioner and adjusts an intake volume of return air from the room inside, and the return air control is to take the return air from the room inside into the temperature/humidity adjustment coil of the air conditioner by closing the first damper and opening the second damper.

Furthermore, an air conditioning method according to a third aspect of the present invention includes: outside air control to take outside air into a temperature/humidity adjustment coil of an air conditioner by opening a first damper and closing a second damper, in which the air conditioner placed to correspond to each room inside or each control zone of the room inside, the room inside or the control zone being as an air conditioning control subject, the first damper is provided in the air conditioner and adjusts an intake volume of the outside air into the air conditioner, and the second damper is provided in the air conditioner and adjusts an intake volume of return air from the room inside; and return air control to take the return air from the room inside into the temperature/humidity adjustment coil of the air conditioner by closing the first damper and opening the second damper. Then, a supply air switching controller connected to the air conditioner alternately switches the outside air control and the return air control at a preset switching interval.

In accordance with the aspects of the present invention, it is possible to perform the air conditioning control in which the maintenance of the amenity and the enhancement of the effect of saving the energy are compatible with each other without requiring the addition of the new instruments of the air conditioner, such as the direct expansion coil.

DETAILED DESCRIPTION OF THE EMBODIMENT

A description will be made of an embodiment of an air conditioning control system using a supply air switching controller of the present invention with reference to the drawings. Note that many recent office buildings have good heat insulating properties and are provided with many personal computers and much office automation equipment, and accordingly, air conditions therein are set in a cooling mode throughout a year. Therefore, in the following embodiment, a description will be made of the case of performing air conditioning control in the cooling mode.

(Configuration of Air Conditioning Control System According to Embodiment)

Figure 1:
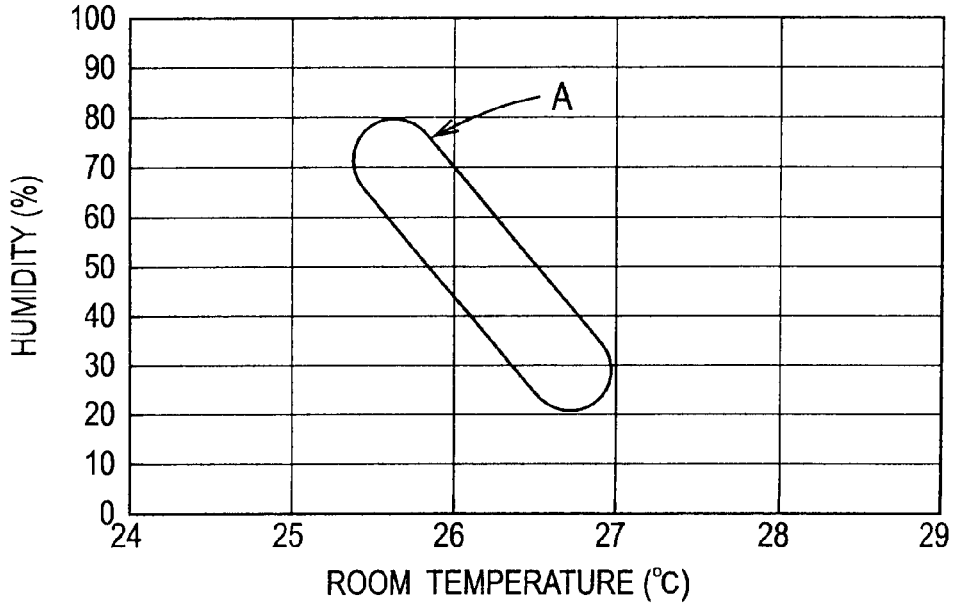
FIG. 1 is a graph showing a relationship between a room temperature and a humidity, which is defined so that an amenity index (predicted mean vote: PMV) can meet a comfortable range of 0.3 to 0.5.
Figure 2:
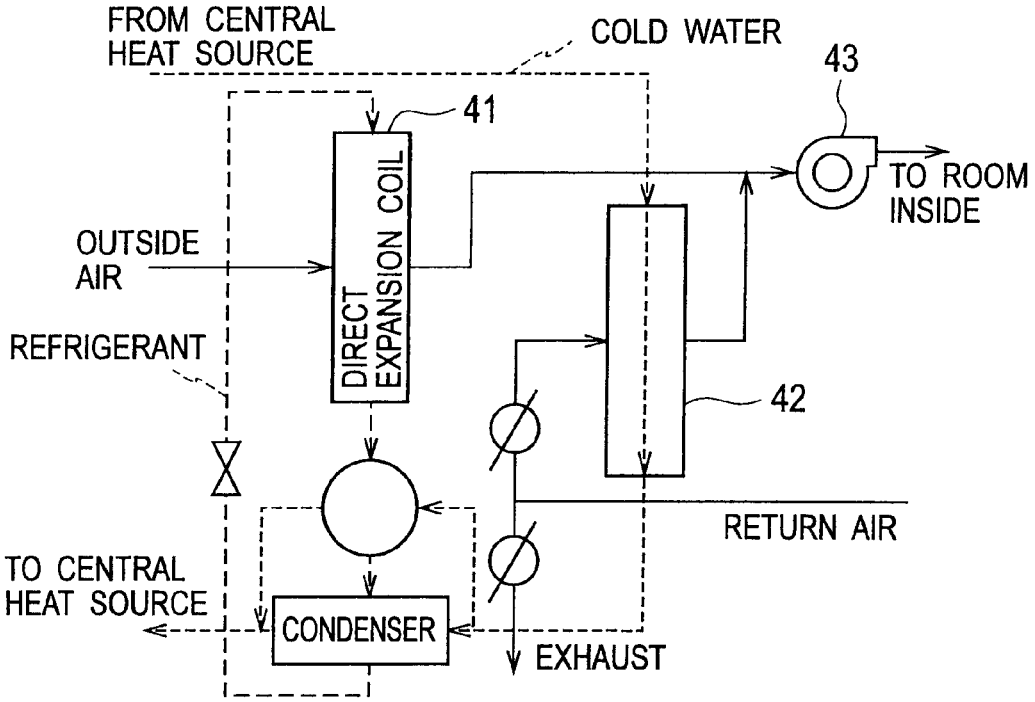
FIG. 2 PRIOR ART
FIG. 2 is a configuration view showing a configuration of an air conditioner described in Patent Publication 1, which can control the temperature and the humidity independently of each other.
Figure 3:
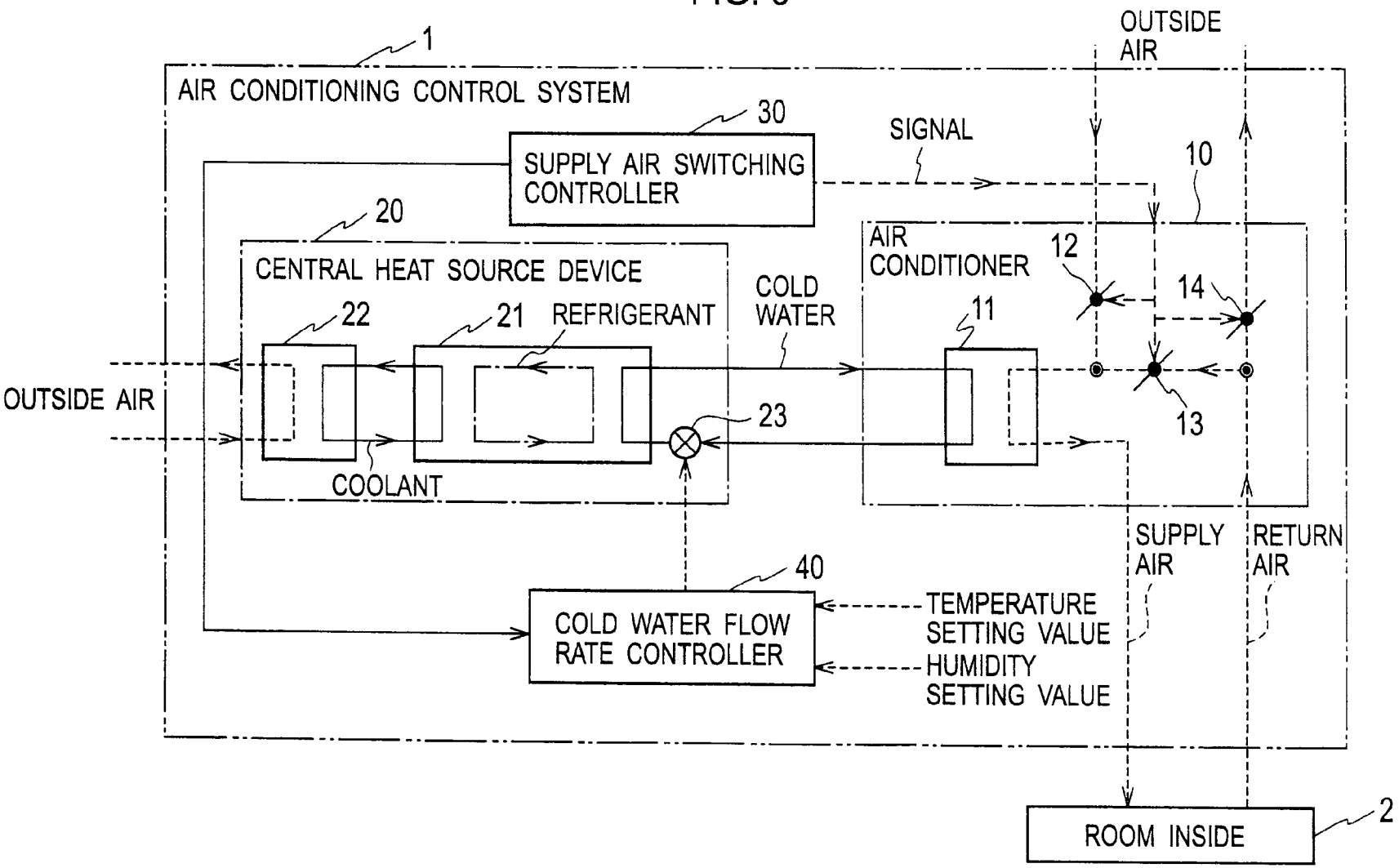
FIG. 3 is an overall view showing a configuration of an air conditioning control system according to an embodiment of the present invention.

FIG. 3 shows an overall view of an air conditioning control system 1 according to an embodiment of the present invention.

Note that, in the case of a large-size building, since an inside of each room thereof is wide, the room is divided into a plurality of control zones. Then, a plurality of air conditioners are placed in a machine room in the vicinities of such room insides so that each thereof can correspond to each control zone. Even in such a case, each control zone is hereinafter referred to as the room inside for the sake of simplification.

The air conditioning control system 1 is a system that controls an air condition of the room inside 2 as an air conditioning subject. The air conditioning control system 1 includes: an air conditioner 10 placed for each room inside 2; a central heat source device 20 that both produces and manages cold water, which is supplied to each air conditioner 10; a supply air switching controller 30 as a damper control unit that switches air, which is to be subjected to air conditioning control processing by each air conditioner 10, between outside air and return air from the room inside 2; and a cold water flow rate controller 40 as a valve control unit that controls a flow rate of the cold water supplied from the central heat source device 20 to each air conditioner 10.

The air conditioner 10 includes: a cold water coil 11 as a temperature/humidity adjustment coil that performs dehumidification/cooling processing for the air to be controlled; a first damper 12 that is placed in an air pipe coupling a space of a room outside and the cold water coil 11 to each other, and adjusts an intake volume of the outside air; a second damper 13 that is placed in an air pipe coupling a space of the room inside 2 and the cold water coil 11 to each other, and adjusts an intake volume of the return air from the room inside 2; and a third damper 14 that is placed in an air pipe coupling the space of the room inside 2 and the space of the room outside to each other, and adjusts a volume of exhaust emitted from the room inside 2 to the room outside.

The central heat source device 20 includes: a refrigerator 21 that creates the cold water, which is supplied to the air conditioner 10, by using coolant; a cooling tower 22 that cools the coolant, of which temperature has risen by cooling the refrigerator 21, by air for the purpose of reuse thereof; and a valve 23 that adjusts, by a degree of opening thereof, the flow rate of the cold water supplied from the refrigerator 21 to the air conditioner 10. Moreover, though not shown, the refrigerator 21 and the cooling tower 22 include pumps which drive the cold water and the coolant, and the cooling tower 22 includes a fan that takes the outside air thereinto.

The supply air switching controller 30 controls openings/closings of the first damper 12, the second damper 13 and the third damper 14 at a preset switching interval. With such a configuration, the supply air switching controller 30 switches the air as the control subject, which is taken into the air conditioner 10, between the outside air and the return air, and performs control so that a required volume of the air as the control subject can be taken into the air conditioner 10 in response to a volume of supply air supplied to the room inside 2. For example, when the outside air is taken into the air conditioner 10, the supply air switching controller 30 performs control to open the first damper 12 and the third damper 14 at degrees of openings, which are according to needs, and to close the second damper 13. Meanwhile, when the return air is taken into the air conditioner 10, the supply air switching controller 30 performs control to close the first damper 12, and to open the second damper 13 and the third damper 14 at degrees of openings, which are according to needs. As a result, the intake volume of the outside air or the return air into the air conditioner 10 is controlled.

This switching interval is such a time that does not affect a room temperature of the room inside 2 as the air conditioning control subject, and for example, is set as an interval of five minutes.

Following the switching interval between the outside air and the return air, which is preset in the supply air switching controller 30, the cold water flow rate controller 40 controls a degree of opening of the valve 23 of the central heat source device 20. For example, when the supply air switching controller 30 performs the control so that the outside air can be taken into the air conditioner 10, the cold water flow rate controller 40 performs control to increase the degree of opening of the valve 23 so that the flow rate of the cold water supplied to the air conditioner 10 can be increased. Meanwhile, when the supply air switching controller 30 performs control so that the return air can be taken into the air conditioner 10, the cold water flow rate controller 40 performs control to reduce the degree of opening of the valve 23 so that the flow rate of the cold water supplied to the air conditioner 10 can be reduced.

(Operations of Air Conditioning Control System According to Embodiment)

Figure 4:
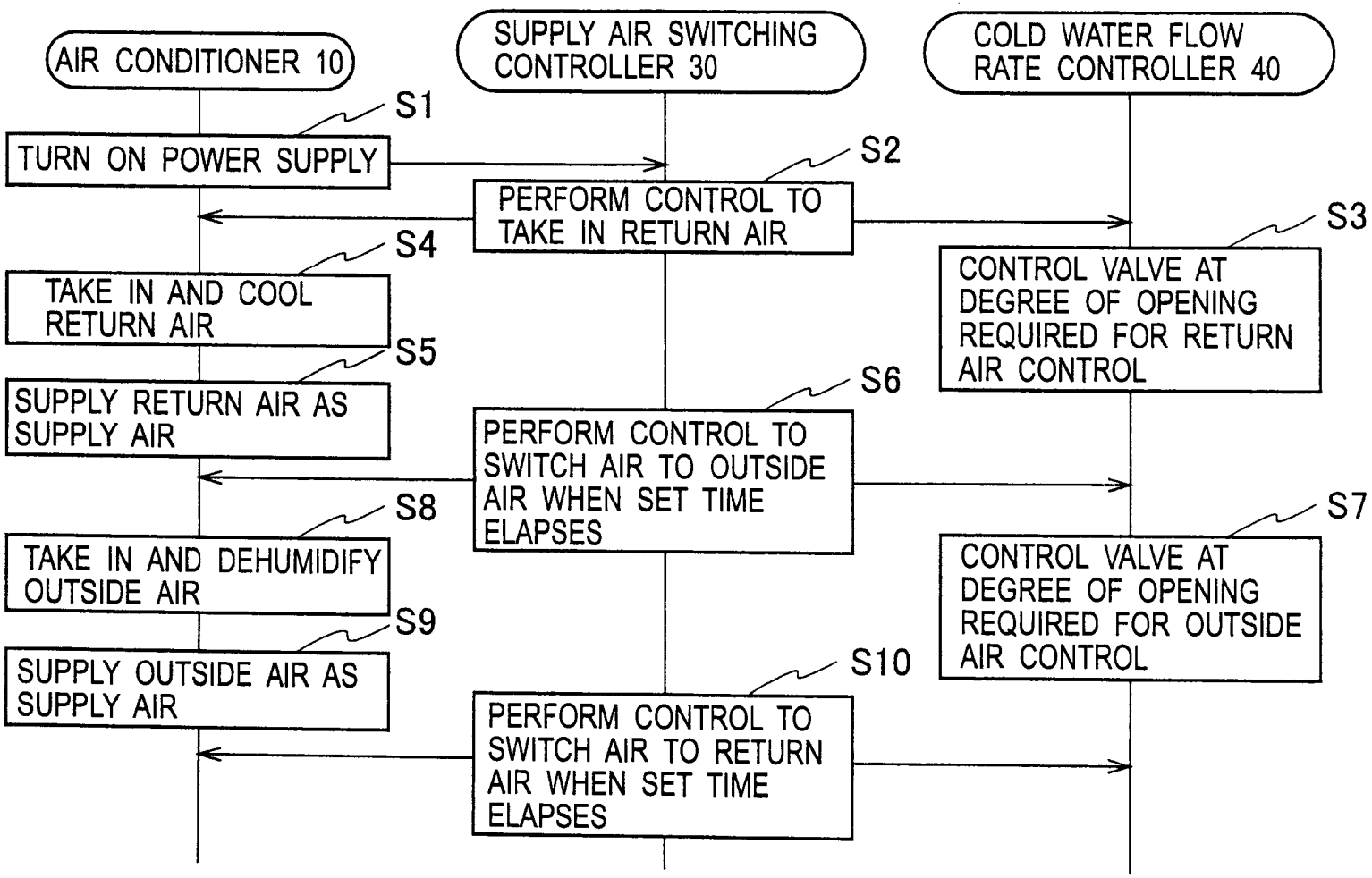
FIG. 4 is a sequence chart showing operations of the air conditioning control system according to the embodiment of the present invention.

A description will be made of operations of the air conditioning control system 1 in this embodiment with reference to a sequence chart of FIG. 4.

In this embodiment, it is assumed that the switching interval is preset in the supply air switching controller 30 so that the outside air and the return air can be taken into the air conditioner 10 while being switched at the interval of five minutes.

First, a power supply of the air conditioner 10 is turned on, and the air conditioning control for the room inside 2 is started (S1). Then, the supply air switching controller 30 performs the control to close the first damper 12, and to open the second damper 13 and the third damper 14 at the degrees of openings, which individually correspond to the required volume of the supply air. As a result, a predetermined volume of the return air from the room inside 2 as the air conditioning control subject is taken into the air conditioner 10, and is supplied to the cold water coil 11 (S2).

Then, the cold water flow rate controller 40 controls the degree of opening of the valve 23 of the central heat source device 20 so as to supply the cold water to the cold water coil 11 at a flow rate corresponding to the return air control (S3).

The control of the degree of opening of the valve 23 by the cold water flow rate controller 40 is performed by calculating a control value based on a temperature measurement value and a humidity measurement value, which are measured in the room inside 2.

The return air from the room inside 2, which is taken into the air conditioner 10, is cooled to a predetermined temperature by the cold water supplied to the cold water coil 11 (S4). Then, the cooled return air is supplied as the supply air to the room inside 2 one more time (S5).

Here, for a fixed time after the air conditioner 10 is activated, for example, at a time before an office starts an operation thereof, persons are hardly present in the room inside, and a concentration of $CO_2$ therein is low. Accordingly, it is not still necessary to ventilate the room inside by the outside air. Therefore, only the control for the return air from the room inside 2 is performed in order to achieve energy saving.

Next, after the fixed time while only the control for the return air is being performed elapses, for example, five minutes as the switching interval preset in the supply air switching controller 30 elapse, the supply air switching controller 30 performs the control to open the first damper 12 and the third damper 14 at the degrees of openings, which are according to needs, and to close the second damper 13. In such a way, the air taken into the air conditioner 10 is switched from the return air from the room inside 2 to the outside air (S6).

When a time of taking in the outside air per hour (3,600 sec) is m (sec), and a time of not taking in the outside air per hour is 3,600-m (sec), the degrees of openings of the dampers just need to be set so that a minimum flow rate of the supply air to the room inside 2 at the time of controlling the outside air as described above can become 3,600/m times a required ventilation volume of the outside air.

For example, in the case where the return air and the outside air are alternately taken into the air conditioner 10 at the interval of five minutes as described above, the time m of taking in the outside air is 1,800 (sec), and the degree of opening of the first damper 12 just needs to be set so that the minimum flow rate of the supply air to the room inside 2 at the time of controlling the outside air can become twice the required ventilation volume of the outside air.

This required ventilation volume of the outside air is obtained, for example, by the following Equation (1):

$$\text{Required ventilation volume of outside air } V\ (\mathrm{m}^3/\mathrm{h}) = 20 \times \text{floor area } S\ (\mathrm{m}^2)/\text{occupied area per person } N\ (\mathrm{m}^2) \quad (1)$$

Here, since S/N represents the number of persons present in the room, a ventilation volume of the outside air of 20 ($m^3$/h) is consequently required per person.

In the case where the number of persons present in the room is indefinite in the above-described Equation (1), the required ventilation volume of the outside air may be calculated by using a standard numerical value of the occupied area per person for each usage purpose of the building. Here, for example, the standard numerical value is 5 $m^2$ for an office, 10 $m^2$ for a hotel, and 2 $m^2$ for a department store.

As described above, the supply air switching controller 30 controls the degrees of openings of the dampers, whereby the air as the control subject is switched so that the outside air can be taken into the air conditioner 10. Then, the cold water flow rate controller 40 controls the degree of opening of the valve 23 of the central heat source device 20 so that cold water at a flow rate corresponding to the control for the outside air can be supplied to the cold water coil 11 (S7).

Then, the outside air taken into the air conditioner 10 is dehumidified by the cold water supplied to the cold water coil 11 (S8), and is supplied as the supply air to the room inside 2 (S9).

Then, when five more minutes as the switching interval elapse after the air taken into the air conditioner 10 is switched to the outside air, the supply air switching controller 30 performs another control to close the first damper 12 and to open the second damper 13 and the third damper 14 at the degrees of openings, which are according to needs. In such a way, the air taken into the air conditioner 10 is switched again from the outside air to the return air from the room inside 2 (S10).

Moreover, when the supply air switching controller 30 switches the air as the control subject so that the return air can be taken into the air conditioner 10, the operations of the air conditioning control system 1 return to Step S3. Specifically, the cold water flow rate controller 40 performs the control to supply the cold water having the flow rate corresponding to the control for the return air to the cold water coil 11, and to cool the return air taken into the air conditioner 10 and supply the cooled return air as the supply air to the room inside 2.

As described above, at every five minutes as the switching interval preset in the supply air switching controller 30, the air as the control subject, which is taken into the air conditioner 10, is switched alternately between the return air and the outside air. As a result, the cooling of the return air and the dehumidification of the outside air are performed separately from each other by the one cold water coil 11.

Here, after the air as the control subject is switched once between the return air and the outside air at the preset switching interval, and the return air and the outside air are taken into the air conditioner 10, an intermittent operation can be performed, in which the operation of the cold water coil 11 is paused by closing the dampers 12 and 13 of the air conditioner 10 for a preset time (n minutes), whereby an effect of saving energy may be enhanced. Such a pausing time just needs to be set at a time that does not affect the room temperature of the room inside 2 as the air conditioning control subject (for example, five minutes).

Moreover, in the above-described air conditioning control system 1, in the case of performing variable air volume (VAV) control, a value of the flow rate of the cold water supplied to the cold water coil 11 is switched by the cold water flow rate controller 40 between the optimum value for the time when the outside air is taken into the air conditioner 10 and the optimum value for the time when the return air is taken thereinto.

Moreover, in the air conditioning control system 1 according to this embodiment, a system control device (not shown) that manages a value of the energy consumed in the air conditioning control system 1 may be further provided. This system control device sets target values of the supply air temperature and the supply air humidity, which are set in the air conditioner 10 so as to minimize an entire energy consumption in the air conditioning control system 1 concerned, and controls a variety of power controllers such as the cold water flow rate controller 40 based on these target values. In such a state, the air conditioner 10 alternately performs the cooling of the return air and the dehumidification of the outside air as described above, whereby the effect of saving the energy can be further enhanced.

The entire energy consumption in the air conditioning control system 1 is represented by the following Equation (2):

$$\text{Entire energy consumption} = \text{energy consumption of cooling tower} + \text{energy consumption of refrigerator} + \text{energy consumption of cold water coil} + \text{energy consumption of pump} + \text{energy consumption of fan} \quad (2)$$

Moreover, in the case of applying the air conditioning control system 1 to district heating and cooling (DHC), the central heat source device 20 is not provided, and the cold/hot water is supplied from the outside to the air conditioning control system 1. In this case, the entire energy consumption is represented by the following Equation (3):

$$\text{Entire energy consumption} = \text{energy consumption of cold water coil} + \text{energy consumption of pump} + \text{energy consumption of fan} \quad (3)$$

As a method of calculating the target values of the supply air temperature and the supply air humidity, which are set so as to minimize such an entire energy consumption in the air conditioning control system 1, there is such a method as described in Specifications of Japanese Patent Laid-Open Publication No. 2008-232507. Specifically, in this method, based on output values of a variety of sensors for use in the air conditioning control, assumed are state quantities necessary to optimize the air condition, for example, physical quantities such as a calorific value generated in the room, a quantity of water vapor generated in the room, and a product of an overall heat transfer coefficient and a heat transfer area in a heat exchanger, whereby it becomes possible to optimally control the entirety of the air conditioning system. Moreover, there is such a method as described in Specifications of Japanese Patent Laid-Open Publication No. 2008-256258. Specifically, in this method, a temporary load of the total air conditioning is calculated at an initial stage from a heat exchange quantity between the heat source machine and the cold water coil under the present conditions, and by using the total air conditioning load as a variable, the air conditioning instruments of the air conditioning system are controlled based on the optimum operation state quantity. Then, when an air state of the space as the air conditioning control subject substantially coincides with a set air conditioning condition, a real load of the total air conditioning is calculated, and the optimum operation state quantity is decided, whereby the air conditioning control system can be operated efficiently, and the energy saving thereof is realized.

The target values of the supply air temperature and the supply air humidity, which are calculated as described above, are transmitted from the system control device to the air conditioner 10. Then, based on the target values of the supply air temperature and the supply air humidity, which are received from the system control device, adjustment processing for the temperature and humidity of the air as the control subject is performed in the air conditioner 10.

Moreover, in this embodiment, when the air conditioner 10 cools and dehumidifies the return air and the outside air in an alternate manner as described above, the cooling and the dehumidification are performed in a state where control target values of the respective devices in the system are set so that a predicted mean vote (PMV) value of the room inside 2 as the air conditioning control subject can stay within a comfortable range (for example, −0.5 to +0.5), whereby energy saving to a large extent can be achieved without sacrificing amenity of residents.

Note that the invention of this application is not limited to the above-described embodiment, and can be embodied while being variously modified within the scope without departing from the gist thereof. For example, in this embodiment, the description has been made of the case of performing both of the control for the outside air and the control for the return air for every five minutes; however, according to needs, the time of the control for the outside air and the time of the control for the return air may be set so as to differ from each other.

In accordance with the air conditioning control system of the above-described embodiment, it is possible to perform air conditioning control in which maintenance of the amenity and enhancement of the effect of saving the energy are compatible with each other without requiring addition of new instruments of the air conditioner.

What is claimed is:

1. An air conditioning control system comprising:

a temperature and humidity adjustment coil that performs adjustment of temperature and humidity of air as a control subject;

a first damper that is placed in an air pipe coupling outside air and the temperature and humidity adjustment coil to each other, and adjusts an intake volume of the outside air;

a second damper that is placed in an air pipe coupling a space of a room inside as an air conditioning control subject and the temperature and humidity adjustment coil to each other, and adjusts an intake volume of return air from the room inside;

a damper control unit that alternately switches outside air control and return air control at a fixed time switching interval, in which the outside air control is to take the outside air into the temperature and humidity adjustment coil for dehumidifying the outside air by opening the first damper at a degree of opening for controlling an introducing amount of the outside air based on a required ventilation volume of the outside air required in the room inside and fully closing the second damper to shut out the return air, and the return air control is to take the return air from the room inside into the temperature and humidity adjustment coil for controlling a temperature of the return air by fully closing the first damper to shut out the outside air and opening the second damper to introduce only the return air, wherein the required ventilation volume is determined based on a floor area and an occupied area per person.

2. The air conditioning control system according to claim 1, further comprising:

a valve that adjusts a flow rate of cold or hot water supplied to the temperature and humidity adjustment coil; and a valve control unit, wherein, when the return air control is switched to the outside air control, the valve control unit is configured to control a degree of opening of the valve to supply the cold or hot water to the temperature and humidity adjustment coil at a flow rate corresponding to the outside air control, and when the outside air control is switched to the return air control, the valve control unit is configured to control the degree of opening of the valve to supply the cold or hot water to the temperature and humidity adjustment coil at a flow rate corresponding to the return air control.

3. The air conditioning control system according to claim 2, wherein, when variable air volume control to vary a volume of the air supplied in the room inside is executed, the valve control unit controls the flow rate of the cold or hot water so that the cold or hot water can be supplied to the temperature and humidity adjustment coil at fixed flow rates set for a time when the outside air control is performed in the damper control unit and for a time when the return air control is performed therein.

4. The air conditioning control system according to claim 1, wherein, after switching air control once between the outside air control and the return air control, the damper control unit performs control to close the first damper and the second damper for a predetermined time in order to pause an operation of the temperature and humidity adjustment coil for the predetermined time.

5. A supply air switching controller comprising:

a damper control unit connected to an air conditioner placed to correspond to each room inside or each control zone of the room inside, the room inside or the control zone being as an air conditioning control subject, wherein the damper control unit alternately switches outside air control and return air control at a fixed time switching interval by controlling a first damper that is provided in the air conditioner and adjusts an intake volume of the outside air into the air conditioner and a second damper that is provided in the air conditioner and adjusts an intake volume of return air from the room inside, in which the outside air control is to take outside air into a temperature and humidity adjustment coil of the air conditioner for dehumidifying the outside air by opening the first damper at a degree of opening for controlling an introducing amount of the outside air based on a required ventilation volume of the outside air required in the room inside, and by fully closing the second damper to shut out the return air, and the return air control is to take the return air from the room inside into the temperature and humidity adjustment coil of the air conditioner for controlling a temperature of the return air by fully closing the first damper to shut out the outside air and opening the second damper to introduce the return air, wherein the required ventilation volume is determined based on a floor area and an occupied area per person.

6. The supply air switching controller according to claim 5, wherein, after switching air control once between the outside air control and the return air control, the damper control unit performs control to close the first damper and the second damper for a predetermined time in order to pause an operation of the temperature and humidity adjustment coil of the air conditioner for the predetermined time.

7. An air conditioning method comprising:

controlling a first damper being provided in an air conditioner and adjusting an intake volume of outside air into the air conditioner, and a second damper being provided in the air conditioner and adjusting an intake volume of return air from a room inside;

performing outside air control to take the outside air into a temperature and humidity adjustment coil of the air conditioner, wherein performing outside air control includes dehumidifying the outside air by opening the first damper at a degree of opening and controlling an introducing amount of the outside air based on a required ventilation volume determined based on a floor area and an occupied area per person of the outside air required in the room inside and fully closing the second damper to shut out the return air;

performing return air control to take the return air from the room inside into the temperature and humidity adjustment coil of the air conditioner, wherein performing return air control includes controlling a temperature of the return air by fully closing the first damper to shut out the outside air and opening the second damper to introduce the return air; and alternately switching, by a supply air switching controller connected to the air conditioner, the outside air control and the return air control at a fixed time switching interval, the air conditioner being placed to correspond to each room inside or each control zone of the room inside, the room inside or the control zone being as an air conditioning control subject.

8. The air conditioning control method according to claim 7, further comprising:

controlling, via a cold or hot water flow rate controller connected to a valve configured to adjust a flow rate of cold or hot water supplied to the temperature and humidity adjustment coil, a degree of opening of the valve to supply the cold or hot water to the temperature and humidity adjustment coil at a flow rate corresponding to the outside air control for dehumidifying the outside air based a predicted mean vote when the return air control is switched to the outside air control by the supply air switching controller; and controlling, via the cold or hot water flow rate controller, the degree of opening of the valve to supply the cold or hot water to the temperature and humidity adjustment coil at a flow rate corresponding to the return air control for controlling a temperature of the return air based on the predicted mean vote when the outside air control is switched to the return air control by the supply air switching controller.

9. The air conditioning control method according to claim 8, wherein, when variable air volume control to vary a volume of the air supplied from the air conditioner is executed, the cold or hot flow rate controller controls the flow rate of the cold or hot water so that the cold or hot water can be supplied to the temperature and humidity adjustment coil at fixed flow rates set for a time when the outside air control is performed and for a time when the return air control is performed.

10. The air conditioning control method according to claim 7, wherein, after switching air control once between the outside air control and the return air control, the supply air switching controller performs control to close the first damper and the second damper for a predetermined time in order to pause an operation of the temperature and humidity adjustment coil for the predetermined time.

* * * * *